US007225637B2

(12) United States Patent
Le Bot

(10) Patent No.: US 7,225,637 B2
(45) Date of Patent: Jun. 5, 2007

(54) INTEGRATED AIR COMPRESSION, COOLING, AND PURIFICATION UNIT AND PROCESS

(75) Inventor: Patrick Le Bot, Vincennes (FR)

(73) Assignee: L'Air Liquide Société Anonyme á Directoire et Conseil de Surveillance pour l'Etude et l'Exploitation des Procédés Georges Claude, Paris (FR)

( * ) Notice: Subject to any disclaimer, the term of this patent is extended or adjusted under 35 U.S.C. 154(b) by 374 days.

(21) Appl. No.: 11/023,003

(22) Filed: Dec. 27, 2004

(65) Prior Publication Data

US 2006/0137393 A1 Jun. 29, 2006

(51) Int. Cl.
*F25J 3/00* (2006.01)

(52) U.S. Cl. ..... 62/644; 62/643

(58) Field of Classification Search ..... 62/643, 62/644, 646, 649

See application file for complete search history.

(56) References Cited

U.S. PATENT DOCUMENTS 3,950,957 A * 4/1976 Zakon ..... 62/644
4,461,154 A 7/1984 Allam
4,557,735 A * 12/1985 Pike ..... 95/99
4,697,415 A * 10/1987 Schiffers ..... 60/39.12
5,137,548 A * 8/1992 Grenier et al. ..... 95/41
5,146,756 A * 9/1992 Lavin ..... 62/646
5,341,647 A * 8/1994 Koeberle et al. ..... 62/650
5,505,050 A 4/1996 Arriulou et al.
5,651,271 A * 7/1997 Fraysse et al. ..... 62/646
5,794,458 A * 8/1998 Naumovitz et al. ..... 62/647

(Continued)

FOREIGN PATENT DOCUMENTS

DE 3908505 9/1989

(Continued)

OTHER PUBLICATIONS

Industrial Gases and Cryogenics Today—Technical Section of the IOMA Broadcaster, Jan.-Feb. 1984, "Air Purification for Cryogenic Air Separation Units", by K.B. Wilson, A.R. Smith, and A. Theobald, pp. 15-20.
International Search Report Dated Mar. 22, 2006.

*Primary Examiner*—William C. Doerrler
(74) *Attorney, Agent, or Firm*—Elwood L. Haynes; Linda K. Russell

(57) ABSTRACT

Process and apparatus for optimization of integrated air separation systems. In an integrated process for the compression, cooling, and purification of air, an adiabatic compressor compresses an air stream to produce a compressed air stream. The compressed air stream is used to warm a first pressurized stream at a first pressure and a second pressurized stream at a second pressure. The produced streams include a first warmed pressurized stream, a second warmed pressurized stream, and a cooled compressed air stream. The first warmed pressurized stream is gaseous and is expanded in a turbine. At least part of the work produced by the turbine is used to power the adiabatic compressor. The cooled compressed air stream is further cooled by a cooling unit by heat exchange with water, and then purified in a purifying unit using a TSA process. At least part of the warmed second pressurized stream is used in cooling the water to be used in the cooling process and/or in warming the gas used to regenerate purifying unit.

16 Claims, 2 Drawing Sheets

U.S. PATENT DOCUMENTS

| | | | | |
|---|---|---|---|---|
| 5,921,106 | A | 7/1999 | Girault et al. | |
| 5,924,307 | A * | 7/1999 | Nenov | 62/643 |
| 6,117,916 | A | 9/2000 | Allam et al. | |
| 6,314,755 | B1 * | 11/2001 | Schoenecker et al. | 62/643 |
| 6,508,053 | B1 * | 1/2003 | Ha et al. | 60/39.12 |
| 2001/0020360 | A1 * | 9/2001 | Tsukamoto et al. | 60/39.53 |
| 2002/0108377 | A1 * | 8/2002 | Guillard | 60/772 |

FOREIGN PATENT DOCUMENTS

| | | |
|---|---|---|
| EP | 0532429 | 3/1993 |
| EP | 1389672 | 2/2004 |
| FR | 2313581 | 12/1976 |

* cited by examiner

INTEGRATED AIR COMPRESSION, COOLING, AND PURIFICATION UNIT AND PROCESS

BACKGROUND

The present invention relates to an integrated air compression, cooling and purification unit and air compression, cooling, and purification process. In particular, it relates to cryogenic air separation units and air separation processes using the air compression, cooling, and purification unit and process.

Certain markets, in particular for the conversion of natural gas, require large amounts of oxygen; therefore, increased sizes of air separation units. It is therefore necessary to increase the dimensions of the air compression systems for the air separation unit.

Generally, compressors with intercoolers are used to feed air separation units. For large plants, the cost of these compressors becomes prohibitive and their size makes them expensive to install.

To get around this problem, several compressors can be used in parallel but this is not very economical.

Usually these large compressors are powered by gas turbines or steam turbines, since the size of electric motors is limited. The steam turbines use the steam generated by the natural gas conversion processes. It is also known that gas turbines use axial compressors to treat air flows much larger than those used for air separation. However, these compressors are adiabatic and their energy consumption is disappointing, or even incompatible with air separation, since the heat of compression is not recycled.

It is known from U.S. Pat. No. 4,461,154 that air compressed in an adiabatic compressor may be used to preheat boiler feed water. U.S. Pat. No. 6,117,916 describes the use of heat from an adiabatic compressor to warm a working fluid before sending the air from the compressor. The air is then further cooled and sent to an air separation unit.

SUMMARY

It is an object of the present invention to use the heat present in the compressed air efficiently so as to generate energy.

The invention provides an integrated process for the compression, cooling, and purification of air in which:

a) an adiabatic compressor compresses an air stream to produce a compressed air stream;

b) the compressed air stream is used to warm a first pressurized stream at a first pressure and a second pressurized stream at a second pressure, and to produce a first warmed pressurized stream, a second warmed pressurized stream, and a cooled compressed air stream;

c) the first warmed pressurized stream is gaseous and is expanded in a turbine;

d) at least part of the work produced by the turbine is used to power the adiabatic compressor;

e) the cooled compressed air stream is further cooled by a cooling unit by heat exchange with water and then purified in a purifying unit using a TSA process; and f) at least part of the warmed second pressurized stream is used in at least one of the following steps: cooling the water to be used in the cooling process and warming the gas used to regenerate the purifying unit.

Additionally, the invention provides an integrated apparatus for the compression, cooling, and purification of air comprising:

a) an adiabatic compressor for compressing an air stream to produce a compressed air stream;

b) at least one heat exchanger and conduits for sending the compressed air stream, a first pressurized stream at a first pressure, and a second pressurized stream at a second pressure, to the at least one heat exchanger, to produce a first warmed pressurized stream, a second warmed pressurized stream, and a cooled compressed air stream;

c) a turbine and a conduit for sending the first warmed pressurized stream to the turbine;

d) means for transferring at least part of the work produced by he turbine to the adiabatic compressor;

e) a cooling unit by heat exchange with water and a conduit for sending the cooled compressed air stream thereto to produce a further cooled compressed air stream;

f) a purifying unit using a TSA process and a conduit for sending thereto the further cooled compressed air stream; and g) a conduit for sending at least part of the warmed second pressurized stream to at least one of the cooling unit and the purifying unit.

The economic use of the heat generated by the adiabatic compression gives rise to a steam consumption equivalent to that of a multi stage compressor, as classically used in air separation.

BRIEF DESCRIPTION OF DRAWINGS

For a further understanding of the nature and objects for the present invention, reference should be made to the following detailed description, taken in conjunction with the accompanying drawings, in which like elements are given the same or analogous reference numbers and wherein.

DESCRIPTION OF PREFERRED EMBODIMENTS

Figure 1:
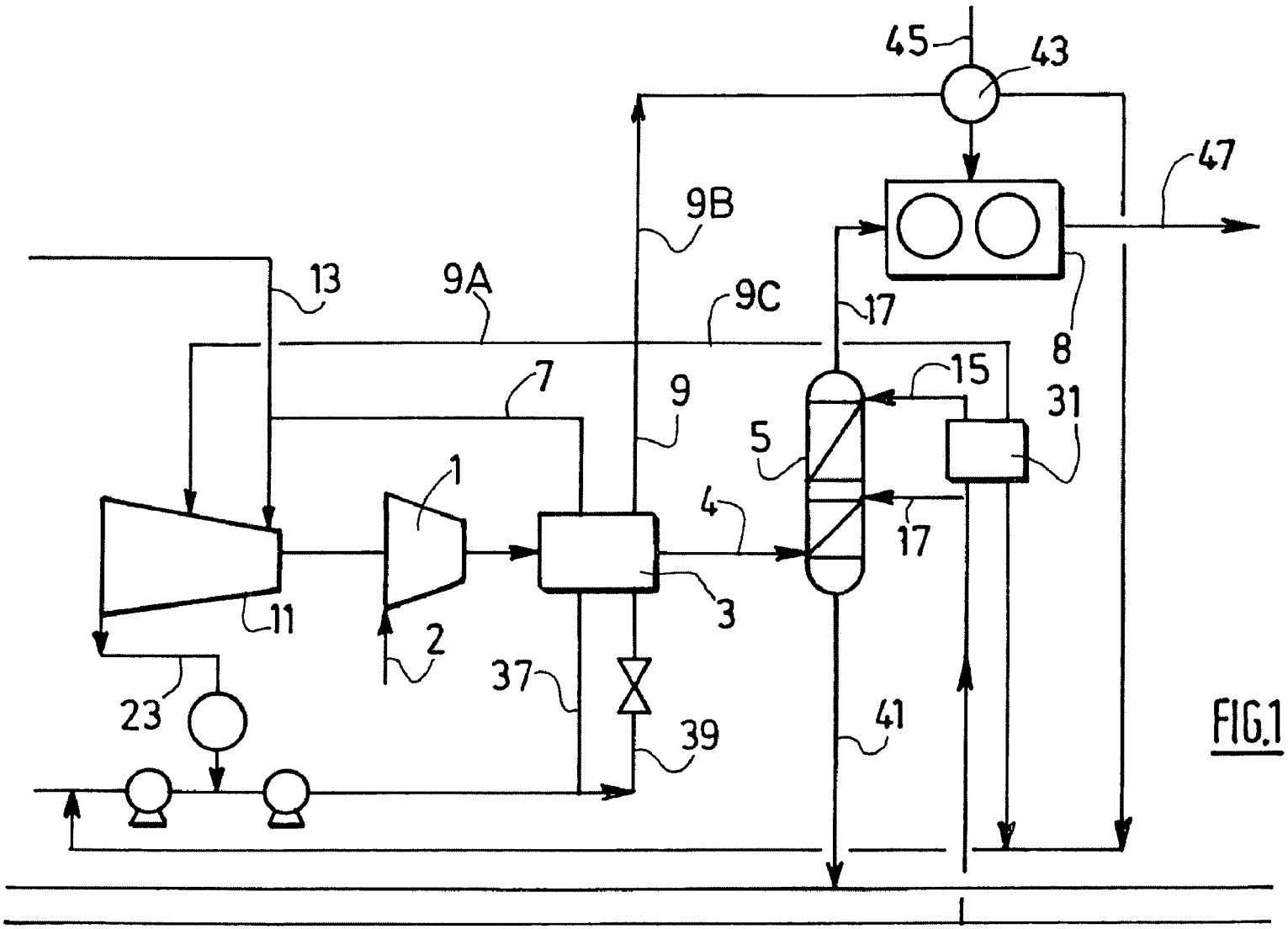
FIG. 1 illustrates a first embodiment of the invention.

The invention provides an integrated process for the compression, cooling, and purification of air in which:

a) an adiabatic compressor compresses an air stream to produce a compressed air stream;

b) the compressed air stream is used to warm a first pressurized stream at a first pressure and a second pressurized stream at a second pressure, and to produce a first warmed pressurized stream, a second warmed pressurized stream, and a cooled compressed air stream;

c) the first warmed pressurized stream is gaseous and is expanded in a turbine;

d) at least part of the work produced by the turbine is used to power the adiabatic compressor;

e) the cooled compressed air stream is further cooled by a c cooling unit by heat exchange with water and then purified in a purifying unit using a TSA process; and f) at least part of the warmed second pressurized stream is used in at least one of the following steps: cooling the water to be used in the cooling process and warming the gas used to regenerate the purifying unit.

The invention may also include one or more of the following aspects:

the cooling process may be an adsorption process; the first and second pressurized streams are water streams;

b) the first and second pressurized streams are vaporized by indirect contact with the compressed air stream to produce first and second streams of steam;

c) the first pressurized stream is at a higher pressure than the second pressurized stream;

d) the first warmed pressurized stream is at a higher pressure than the second warmed pressurized stream;

e) at least part of the second warmed pressurized stream is expanded in the turbine;

f) at least part of the second warmed pressurized stream expanded in the turbine is sent to an intermediate stage of the turbine;

g) the air cooled against the first and second pressurized streams is sent to an air separation unit following said further cooling and purification;

h) the air cooled against the first and second pressurized streams is further cooled in the cooling unit by direct contact with at least one stream of water and sent to an air separation unit and the at least one stream of water is cooled by using at least part of the second warmed pressurized stream in an absorption type refrigeration unit; and i) the air cooled against the first and second pressurized streams is purified in a purification unit and sent to an air separation unit, the air separation unit produces a nitrogen rich stream used to regenerate the purification unit and at least part of the second warmed pressurized stream is used to warm the nitrogen rich stream upstream of the purification unit.

Additionally, the invention provides an integrated apparatus for the compression, cooling, and purification of air comprising:

a) an adiabatic compressor for compressing an air stream to produce a compressed air stream;

b) at least one heat exchanger and conduits for sending the compressed air stream, a first pressurized stream at a first pressure and a second pressurized stream at a second pressure, to the at least one heat exchanger, to produce a first warmed pressurized stream, a second warmed pressurized stream, and a cooled compressed air stream;

c) a turbine and a conduit for sending the first warmed pressurized stream to the turbine;

d) means for transferring at least part of the work produced by he turbine to the adiabatic compressor;

e) a cooling unit by heat exchange with water and a conduit for sending the cooled compressed air stream thereto to produce a further cooled compressed air stream;

f) a purifying unit using a TSA process and a conduit for sending thereto the further cooled compressed air stream; and g) a conduit for sending at least part of the warmed second pressurized stream to at least one of the cooling unit and the purifying unit.

The invention may additionally comprise one or more of the following features:

a) a turbine and a conduit for sending at least part of the second warmed pressurized stream to the turbine;

b) a conduit for sending the at least part of the second warmed pressurized stream expanded in the turbine to an intermediate stage of the turbine; and c) the cooling unit is a direct contact cooling unit and comprises a conduit for sending water to the cooling unit, an absorption type refrigeration unit for cooling the water and a conduit for sending at least part of the second warmed pressurized stream to the refrigeration unit.

According to one embodiment of the invention, there is provided an air separation unit comprising an apparatus, as described above, a further heat exchanger for cooling the air cooled in the cooling unit and a distillation column system, a conduit for sending air to a column of the column system, and a conduit for removing a product from a column of the column system.

The unit may comprise a heat exchanger, a conduit for sending a nitrogen rich stream from the column system to the heat exchanger, and thence to the purification unit, and a conduit for sending at least part of the second warmed pressurized stream to the heat exchanger to warm the nitrogen rich stream upstream of the purification unit.

The economic use of the heat generated by the adiabatic compression gives rise to a steam consumption equivalent to that of a multi stage compressor, as classically used in air separation.

In FIG. 1, an adiabatic compressor 1 is used to compress an air stream 2. If compressed to around 7 bars abs, the air is at a temperature of around 350° C. The air is then sent to a heat exchanger 3 where it is used to heat two streams of water 37, 39 at two different pressures to form streams of steam 7, 9 at two different pressures, for example, 5 bars abs and 30 bars abs. It will be understood that several heat exchangers could replace exchanger 3 depending on the number of streams of steam to be produced.

The air 4 cooled in exchanger 3 is sent to the bottom of a cooling tower 5 where it exchanges heat by direct contact with water 15, 17 introduced at two separate points. Stream 15 is cooled before entering the cooling tower in an adsorption type cooling unit 31 using at least part of stream 9 (here shown as partial stream 9C).

The air 17 cooled in the cooling tower 5 is then purified in purification unit 8 to produce air stream 47. This stream is then further cooled and sent to the columns of a cryogenic air separation unit, which may be of any known type.

The purification unit is periodically regenerated by a nitrogen rich stream 45 produced by the air separation unit fed by air stream 47. This nitrogen rich stream 45 is warmed, preferably to the regeneration temperature using at least part of stream 9 (here shown as partial stream 9B).

The turbine 7 is fed by first warmed pressurized stream 7 sent to the entrance of the turbine, preferably mixed with another stream of steam 13. At least part of stream 9 (here shown as partial stream 9A) is sent to an intermediate level of the turbine 7.

The expanded steam 23 is condensed and recycled, together with either or both of the partial condensed streams 9B, 9C to the inlet of exchanger 3, following pumping. The water stream 37, 39 may both be pumped to different pressures, or as shown both streams are pumped to a common pressure and one 39 is expanded. Obviously, it is also possible to pump both stream to a common pressure and to further pump stream 37 to a higher pressure.

Figure 2:
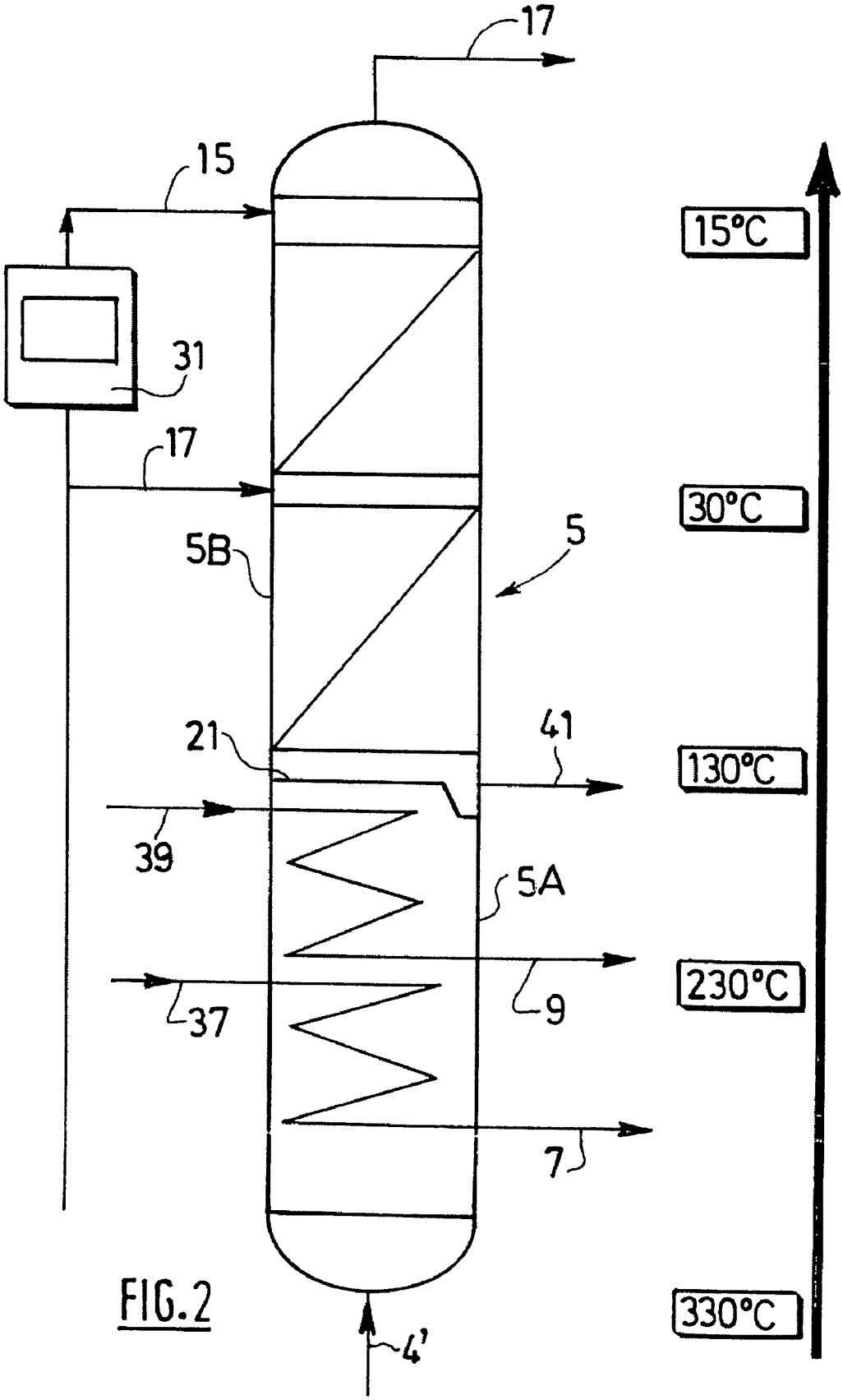
FIG. 2 illustrates a second embodiment of the invention.

According to a further embodiment as shown in FIG. 2, the separate exchanger 3 is not required, the function of this exchanger being integrated into the cooling tower 5. The heat exchange between the streams of water 37, 39 and the air coming directly from compressor 1 takes place at the bottom of the cooling tower 5. The cooling tower 5 is divided into two compartments: a first compartment 5A in which the indirect contact takes place between the hot air 4 and the streams of water 37, 39 and a second compartment 5B in which the direct contact takes place between the air cooled in the first compartment and at least one water stream 15, 17 introduced into the second compartment. A barrier 21 prevents water passing down the second compartment 5B penetrating the first compartment 5A, but allows air to pass upwardly from the first compartment into the second compartment 5B.

In the first compartment 5A, the water stream at the higher pressure 37 circulates in a coil 137 at the bottom of the compartment where the temperature is highest and the water stream at the lower pressure 39 circulates in another coil 139 above coil 137 where the temperature is lower. It will be appreciated that any number of streams of water and/or coils may be used.

The second compartment 5B contains trays, structured packing, random packing or any other packing allowing mass and heat transfer between air and water. The water stream 15 following cooling in adsorption type cooling unit 31 is introduced at the top of the tower and water stream 17 is introduced at an intermediate point of the second compartment 5B. The air rises up the second compartment 5B from the first compartment and is cooled therein by direct heat transfer with the water. The warmed water 41 is removed at the bottom of the second compartment and then recycled to the cooling tower (not shown) in a manner well known from the prior art.

An example of a process using the installation of FIG. 1 will be described. A gas turbine has a compressor, which compresses an air flow of $10^6$ $Nm^3/h$, i.e. air to feed a 7,000 tons per day air separation unit. In normal operation, the compressor 1 compresses the air to 11, to a pressure of 8 bars and its speed of rotation is 3,600 rpm.

If only the low-pressure section of the compressor is kept, the compressor becomes suitable for feeding an air separation unit and could be powered by a 3,600 rpm steam turbine.

If the compressor output is 6 bars, a 91 MW steam turbine is required to power the compressor. The real steam consumption is equivalent to that of a 71 MW compressor.

An electric motor can be used in addition to the steam turbine to power the adiabatic air compressor.

It will be appreciated that while one embodiment of the invention has been shown and described hereinbefore, many modifications may be made by the person skilled in the art without departing from the spirit and scope of this invention.

What is claimed is:

1. An integrated process for the compression, cooling, and purification of air in which:

a) an adiabatic compressor compresses an air stream to produce a compressed air stream;

b) said compressed air stream is used to warm a first pressurized stream at a first pressure and a second pressurized stream at a second pressure, and to produce a first warmed pressurized stream, a second warmed pressurized stream, and a cooled compressed air stream;

c) said first warmed pressurized stream is gaseous and is expanded in a turbine;

d) at least part of the work produced by said turbine is used to power said adiabatic compressor;

e) said cooled compressed air stream is further cooled by a cooling unit by heat exchange with water, and then purified in a purifying unit using a TSA process; and f) at least part of said warmed second pressurized stream is used in at least one of the following processes selected from the group consisting of:

(i) cooling said water to be used in said cooling process; and (ii) warming said gas used to regenerate said purifying unit.

2. The process of claim 1, wherein said first and second pressurized streams are water streams.

3. The process of claim 2, wherein said first and second pressurized streams are vaporized by indirect contact with said compressed air stream to produce first and second streams of steam.

4. The process of claim 1, wherein said first pressurized stream is at a higher pressure than said second pressurized stream.

5. The process of claim 1, wherein said first warmed pressurized stream is at a higher pressure than said second warmed pressurized stream.

6. The process of claim 1, wherein at least part of said second warmed pressurized stream is expanded in said turbine.

7. The process of claim 6, wherein said at least part of said second warmed pressurized stream expanded in said turbine is sent to an intermediate stage of said turbine.

8. The process of claim 1, wherein said air cooled against said first and second pressurized streams is sent to an air separation unit following said further cooling and purification.

9. The process of claim 8, wherein the air cooled against said first and second pressurized streams is further cooled in said cooling unit by direct contact with at least one stream of water and sent to an air separation unit and said at least one stream of water is cooled by using at least part of said second warmed pressurized stream in an absorption type refrigeration unit.

10. The process of claim 9, wherein said air cooled against said first and second pressurized streams is purified in a purification unit and sent to an air separation unit, said air separation unit produces a nitrogen rich stream used to regenerate said purification unit and at least part of said second warmed pressurized stream is used to warm said nitrogen rich stream upstream of said purification unit.

11. An integrated apparatus for said compression, cooling, and purification of air comprising:

a) an adiabatic compressor for compressing an air stream to produce a compressed air stream;

b) at least one heat exchanger and conduits for sending said compressed air stream, a first pressurized stream at a first pressure, a second pressurized stream at a second pressure, to said at least one heat exchanger to produce a first warmed pressurized stream, a second warmed pressurized stream, and a cooled compressed air stream;

c) a turbine and a conduit for sending said first warmed pressurized stream to said turbine;

d) means for transferring at least part of said work produced by said turbine to said adiabatic compressor;

e) a cooling unit by heat exchange with water;

f) a conduit for sending said cooled compressed air stream thereto to produce a further cooled compressed air stream;

g) a purifying unit using a TSA process and a conduit for sending thereto said further cooled compressed air stream; and h) a conduit for sending at least part of said warmed second pressurized stream to at least one of said cooling unit and said purifying unit.

12. The apparatus of claim 11, comprising a turbine and a conduit for sending at least part of said second warmed pressurized stream to said turbine.

13. The apparatus of claim 12, comprising a conduit for sending said at least part of said second warmed pressurized stream expanded in said turbine to an intermediate stage of said turbine.

14. The apparatus of claim 12, wherein said cooling unit is a direct contact cooling unit and comprises a conduit for sending water to said cooling unit, an absorption type refrigeration unit for cooling said water, and a conduit for sending at least part of said second warmed pressurized stream to said refrigeration unit.

15. An air separation unit comprising an apparatus according to claim 12, further comprising an additional heat exchanger for cooling said air cooled in said cooling unit and a distillation column system, a conduit for sending air to a column of said column system, and a conduit for removing a product from a column of said column system.

16. The unit of claim 15, comprising:

a) a heat exchanger;

b) a conduit for sending a nitrogen rich stream from said column system to said heat exchanger and thence to said purification unit; and c) a conduit for sending at least part of said second warmed pressurized stream to said heat exchanger to warm the nitrogen rich stream upstream of said purification unit.

* * * * *